US007920094B2

(12) United States Patent
Hansen

(10) Patent No.: US 7,920,094 B2
(45) Date of Patent: Apr. 5, 2011

(54) ANTENNA STRUCTURE HAVING PATCH ELEMENTS

(75) Inventor: Thomas Hansen, Hildesheim (DE)

(73) Assignee: Robert Bosch GmbH, Stuttgart (DE)

( * ) Notice: Subject to any disclaimer, the term of this patent is extended or adjusted under 35 U.S.C. 154(b) by 74 days.

(21) Appl. No.: 11/660,424

(22) PCT Filed: Jun. 17, 2005

(86) PCT No.: PCT/EP2005/052822
§ 371 (c)(1),
(2), (4) Date: Sep. 26, 2007

(87) PCT Pub. No.: WO2006/018338
PCT Pub. Date: Feb. 23, 2006

(65) Prior Publication Data

US 2008/0211720 A1 Sep. 4, 2008

(30) Foreign Application Priority Data

Aug. 17, 2004 (DE) ..... 10 2004 039 743

(51) Int. Cl.
*H01Q 1/38* (2006.01)
*H01Q 21/08* (2006.01)

(52) U.S. Cl. ..... 343/700 MS; 343/853; 343/810; 343/824; 343/825; 343/826

(58) Field of Classification Search ..... 343/700 MS, 343/846, 737, 770, 824, 853
See application file for complete search history.

(56) References Cited

U.S. PATENT DOCUMENTS

| | | | |
|---|---|---|---|
| 3,995,277 | A | 11/1976 | Olyphant, Jr. et al. |
| 4,079,268 | A | 3/1978 | Fletcher et al. |
| 4,742,354 | A | 5/1988 | Wen et al. |
| 2003/0107518 | A1 | 6/2003 | Li et al. |

FOREIGN PATENT DOCUMENTS

| | | |
|---|---|---|
| DE | 199 51 123 | 2/2001 |
| EP | 1199772 | 4/2002 |
| WO | WO 2002 07 1535 | 9/2002 |

OTHER PUBLICATIONS

Volski V. et al; Compact Low-Cost 4 Elements Microstrip Antenna Array for WLAN; Wireless Technology, 2004, 7th European Conference on Amsterdam, The Netherlands; Oct. 11-12, 2004.

*Primary Examiner* — Trinh V Dinh
(74) *Attorney, Agent, or Firm* — Kenyon & Kenyon LLP

(57) ABSTRACT

In an antenna structure having a plurality of serially fed patch elements, at least one of the patch elements has a slot coupling to the continuation of the feed line for influencing the radiation of this patch element.

17 Claims, 6 Drawing Sheets

ANTENNA STRUCTURE HAVING PATCH ELEMENTS

RELATED APPLICATIONS

This application is a 371 of PCT/EP05/52822 filed Jun. 17, 2005, which claims priority under 35 U.S.C. 119 to an application GERMANY 10 2004 039 filed on Aug. 17, 2004, the contents of which are incorporated herein by reference.

FIELD OF THE INVENTION

The present invention relates to an antenna structure having a plurality of serially fed patch elements.

BACKGROUND INFORMATION

In the field of driver assistance functions having forward-looking detection systems, radar sensor systems are used, which operate primarily in the frequency range of 76 GHz to 77 GHz. These are used, for example, for implementing the "adaptive cruise control" (ACC) assistance function in the speed range of 50 km/h to 180 km/h. Radar sensors are also used for applications in the lower speed range and are advantageous for other comfort and safety functions such as blind spot monitoring, backing and parking assistance, or "pre-crash functions" (deployment of reversible restraint systems, arming of airbags, etc., preconditioning of the brake system, automatic emergency brake).

Typically, 77 GHz radar sensors operate using lens antennas. A plurality of partially overlapping beam lobes is formed over a plurality of feed antennas which are located in the focal plane of the lens ("analog" beam formation). FIG. 1 illustrates this principle. The azimuthal angle position of the target object is determined using the signal amplitudes and/or signal phases in the individual beam lobes. The relatively high overall depth of a few centimeters resulting from the required distance of the feed antennas (in the focal plane) from the lens is characteristic for lens antennas.

"Analog" beam formation may, however, also be achieved with a planar structure using planar antennas, so that the overall depth is substantially reduced. Corresponding circuits for beam formation such as the Butler matrix, Blass matrix, or planar lenses (Rotman lens) are known (German Patent No. DE 199 51 123). A planar group antenna is used as the antenna.

However, other methods for signal analysis, in particular for determining radar target angles, which require no "analog" beam formation, are also known. The received signals are processed and digitized separately for each of the antenna elements, and the beam is formed on the digital level ("digital" beam formation). In addition to the "digital" beam formation, there are also methods using which the azimuthal angle position of the target object may be determined without any need for beam formation, e.g., high-resolution direction estimation methods.

A particularly simple and cost-effective design of a planar antenna is based on serial feed of the elements in one dimension of the antenna. Serial feed in the antenna columns is relevant in particular for motor vehicle radar sensors. In this case, the columns are situated in the elevation direction, i.e., vertically.

Slot couplings in connection with patch elements are known per se (U.S. Patent Publication No. 2003 010 75 18, PCT Patent Publication No. WO-2002 07 1535, European Patent Application No. EP 1199772). Such slots are used for adapting and influencing the bandwidth.

SUMMARY OF THE INVENTION

According to the present invention, individual patch elements, in particular in a serial feed chain, may exhibit increased radiation and thus improved possibility of beam formation and side lobe suppression. By combining conventional patch elements with the patch elements, any required radiation of the signal applied to the input of this element may be set on each patch element of a planar, serially fed antenna column. Variable beam formation and side lobe suppression in the plane of an antenna column may thus be achieved. Different possibilities for the design of the slot coupling between patch element and continuation of the feed line are provided. This provides a plurality of degrees of freedom for optimizing the desired radiation which may be advantageously combined.

Compared to conventional patch antennas, using the measures of the present invention, the radiation of individual patch elements may be set in the range of 20% to 100% in particular and thus the overall radiation profile of an antenna column may be varied in a much wider range of amplitudes and/or angles than by using a conventional patch structure. This variation of the overall radiation profile allows a serially fed antenna column to be optimized for a plurality of possible applications, for example, wide radiation diagram in the close range, narrow radiation diagram in the far range, and highly side lobe-suppressed radiation diagram for reducing ground clutter and undesirable bridge detection, and the like.

DETAILED DESCRIPTION

Before discussing the present invention, relevant conventional antenna structures will first be explained to provide a clearer understanding.

A serially fed antenna column is characterized in that a plurality of antenna elements is coupled to a normally straight feed line.

An electromagnetic wave is fed to the feed line (transmitting antenna) or picked up (receiving antenna) at one end of the antenna column. The electromagnetic wave may also be fed within the antenna column, usually in the center. However, this results in a complex and thus cost-intensive design of the antenna.

The elements are coupled in a way that the antenna element emits only part of the power of the electromagnetic wave incident from one side or only part of the power available on the feed line is injected into the antenna element. The electromagnetic wave containing the remaining power continues to run on the feed line to the other side of the element. In addition, mainly ohmic losses occur on the feed line and in the antenna elements. The end of the antenna column opposite the feed is normally terminated with low reflection or provided with an antenna element which is designed in such a way that in transmission operation it emits all the power injected into it. In this case the antenna is referred to as a "traveling wave antenna" (leaky wave antenna). If a standing wave is formed on the antenna column because, for example, the end of the column is not terminated reflection-free, for example, with idling or short circuit, the antenna is referred to as a "standing wave antenna." On such an antenna column, the elements are normally connected to the "current nodes."

Patches, dipoles, "slots," or "stubs" may be used as antenna elements. These elements may be grouped via connecting lines to form subgroups. A plurality of patches may be situated one above the other in multilayer structures, so that they are electromagnetically coupled, in order to increase the bandwidth. The antenna elements may be coupled directly, capacitively, or via stubs using slot coupling, for example.

Figure 1:
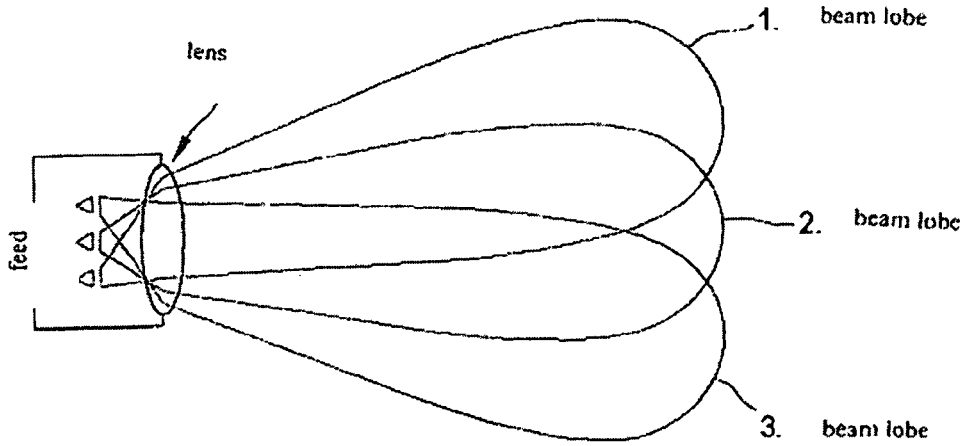
Fig. 1 Prior Art
FIG. 1 shows the formation of a plurality of beam lobes by a plurality of feeds in the case of a lens antenna.
Figure 2A:
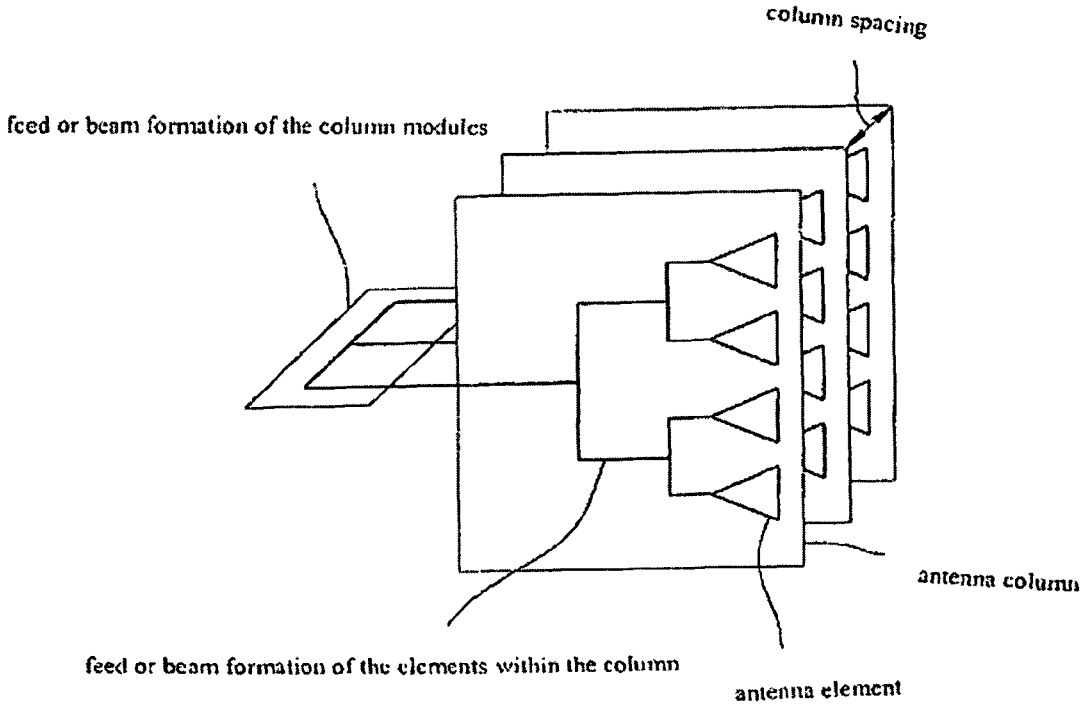
Fig. 2a Prior Art
FIG. 2*a* shows a three-dimensional design of a group antenna.
Figure 2B:
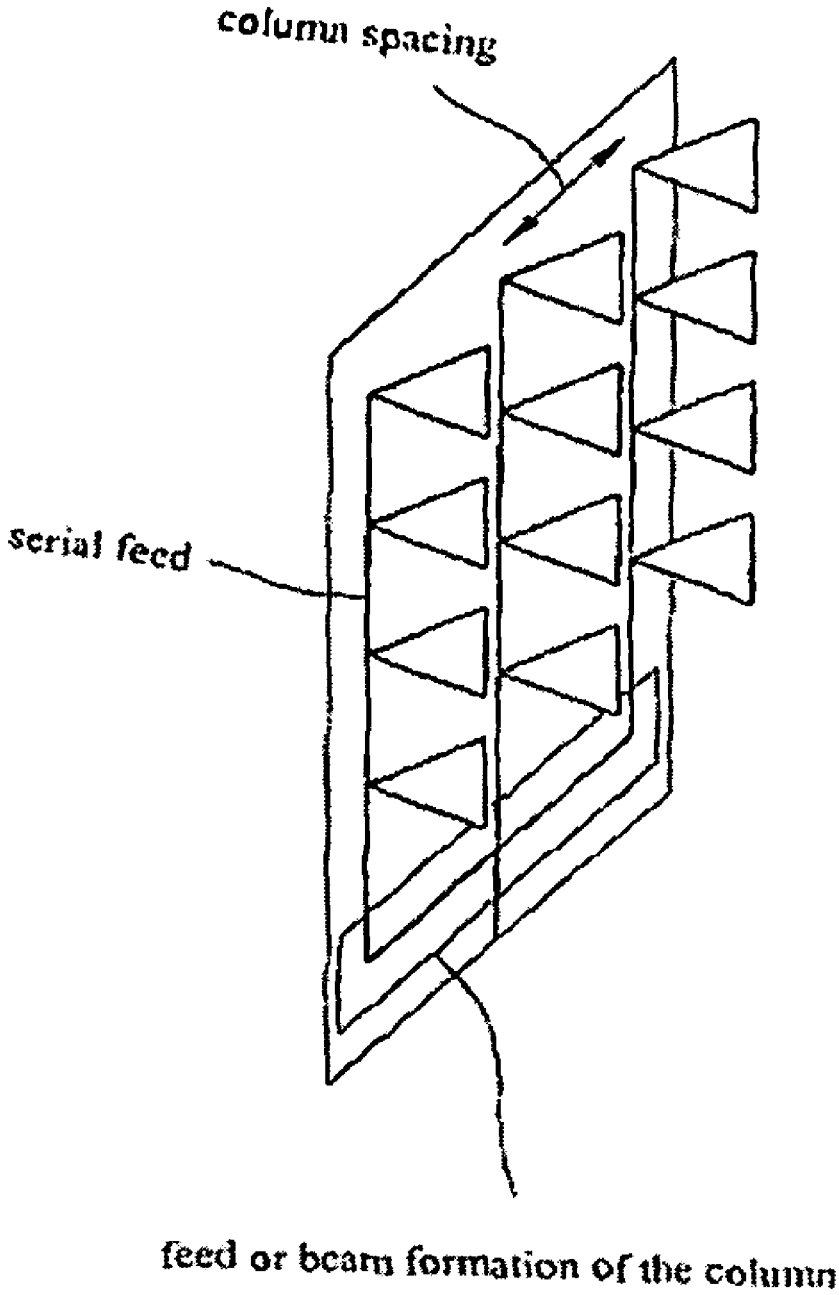
Fig. 2b Prior Art
FIG. 2*b* shows a planar design of a serially fed group antenna.

If antenna columns are to be situated side by side, for example, in a 77 GHz radar sensor, so that "digital" beam formation or "high-resolution" direction estimation method is possible using the signals of the antenna columns, then a spacing between the columns on the order of magnitude of one-half of the free-space wavelength of the radar signal, approximately 2 mm for 77 GHz, is necessary. The same applies to regular "analog" beam formation methods; however, a modification to greater spacings between columns within certain limits is possible here in principle. If the number of antenna elements in the column exceeds a certain number—on the order of 5—in a planar design there is no alternative to serial feed for reasons of space. This alternative is usually circumvented in antenna systems for military or satellite applications by selecting a three-dimensional design. Such a design is schematically shown in FIG. 2*a*. The column is fed or activated for example by "analog" beam formation downstream from the elements, so that the modules having the columns may be arranged at a short distance next to one another. Such an arrangement is not feasible for motor vehicle radar sensors due to the high costs and considerable overall dimensions. FIG. 2*b* shows a planar design having serial feed. The individual columns are fed from a signal source via a power divider.

The elevation of the main lobe of the radar antenna of a motor vehicle radar sensor is designed in such a way that vehicles are properly detected over the distance range covered by the sensor. If the operating range of the sensor is limited to just the far range (typical ACC), the main lobe may have a rather narrow elevation. If the operating range of the sensor is to also extend to the close range, it may be necessary to provide a wider main lobe to cover the height of vehicles. Ideally the main lobe is designed in such a way that undesirable reflections from the ground or from targets above the vehicles to be detected are avoided.

To further reduce detection of undesirable radar targets ("clutter"), the beam characteristic of the radar antenna should be designed in such a way that the elevation of the side lobes is as small as possible. Clutter is generated by irradiation or detection of ground roughness, ground unevenness, drain covers, extraneous objects, etc., as well as bridges, sign gantries, tunnel surfaces, trees, etc., for example.

The traditional method for setting the side lobe level is based on an amplitude distribution decreasing toward the edges of the column ("taper") of the electromagnetic wave imitated by the individual elements. Corresponding distribution functions, for example, Chebyshev or Taylor functions, are found in the literature. In this case, a constant distance between the elements, normally of one-half of the free-space wavelength, and a constant phase difference between the antenna elements are assumed, or a co-phasal state if the radiation is to take place in the direction of the antenna normal. The width of the main lobe results from the selected amplitude distribution, the number of elements and their spacing in the column.

This amplitude distribution may be implemented either via an appropriate power divider via which the antenna elements, which in general have an identical design, are fed (see feed within the columns in FIG. 2*a*), or the antenna elements or their coupling to the feed and thus their radiation may be varied within the antenna. The first method is in general incompatible with serial feed for reasons of space. In principle, the latter method may also be used in the case of serial feed.

Depending on the antenna element used, the latter method is, however, subject to limitations. In the case of a serially fed antenna column having directly coupled patch elements, the radiation of the elements may be set only within certain limits. These limits are determined mainly by the maximum width of the antenna elements, which are determined by the electromagnetic coupling of the antenna columns and by the start of oscillations of the first transversal mode in a patch element when the width of the patch is on the order of magnitude of one-half of the line wavelength.

The present invention describes an antenna structure, in particular for a motor vehicle radar sensor having a planar antenna, whose antenna columns are designed using serial feed, individual patch elements having an increased radiation compared to the related art and thus offering improved possibilities of beam formation and side lobe suppression.

The antenna structure according to the present invention having slot coupling of the patch elements with respect to the continuation of the feed line for the use in planar serially fed antenna columns, in particular in a motor vehicle radar sensor, allows variable beam formation and side lobe suppression in the plane of the antenna column. The antenna columns in a motor vehicle radar sensor are usually situated in the elevation direction and the above-mentioned plane is the elevation plane.

The advantage is that the combination of the conventional and inventive patch elements on each patch element of a planar, serially fed antenna column allows any necessary radiation of the signal applied to the input of this element to be set.

Planar, serially fed antennas in motor vehicle radar sensors are usually constructed using stripline technology. A single-layer or multilayer microwave substrate is metal plated on both sides. At least one of the two metal layers is structured and forms the signal line plane. The feed lines, antenna columns, and, optionally, the transmitting and receiving modules or parts thereof are situated in the signal line plane. The other metal plane forms the ground plane. Additional substrate planes and metal planes, in which the low-frequency/base band electronics and digital electronics for processing the low-frequency/base band signals and for triggering and, in particular, digital signal processing are constructed, may be situated underneath the ground plane. Additional microwave substrate planes, on which the transmitting and receiving modules are optionally installed, for example, may also be used in combination therewith.

FIGS. 3*a*-3*d* schematically show different embodiments of a serially fed antenna column 1. Feed lines 50 of the antenna column are situated in the above-mentioned signal line plane. They are typically designed as micro-striplines; a plurality of sections having different impedances for impedance adaptation may occur. The patch elements in the form of widened line segments 20 are coupled to feed line 50. A patch element 10, which emits all incident power so that no reflection occurs, may be used at the end of the column. Alternatively an absorbent termination, for example, an absorber glued onto the continuation of feed line 50 or an adapted termination having a resistor, may also be used, which, however, further complicates the manufacture of the antenna and therefore does not represent a first choice.

Continuously decreasing available power from feed 60 or 70, in the case of central feed, to the end of the column is characteristic for serially fed antenna column 1. Each patch element 20 emits a fraction of the power available at the site of the patch element or at the site of the element's coupling. Losses, primarily ohmic losses, also occur in the patch elements and on the feed line between the patch elements. When all patch elements 20, spacings d of the patch elements and feed line 50 between the patch elements are the same, then the power distribution from the feed to the end of the column is approximately exponentially decreasing; patch element 10 at the end of the column may emit a power deviating from this curve. This power distribution determines the beam formation of the beam lobe generated by the column, the side lobe suppression being usually worse than 14 dB (13.6 dB is achieved in an even distribution of the power). This value is usually insufficient for applications in motor vehicle radar systems.

Power distributions having a maximum in the center of the antenna column and decreasing continuously toward the edges deliver a particularly good side lobe suppression. Such functions are known, for example, as Chebyshev's or Taylor's weight functions, a constant spacing of the antenna elements being assumed.

Figure 3A:
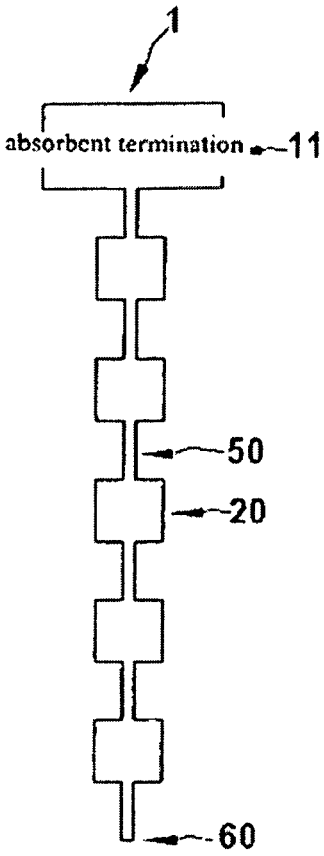
Fig. 3a Prior Art
FIGS. 3*a* through 3*d* show different embodiments of conventional planar, serially fed antenna columns.
Figure 3B:
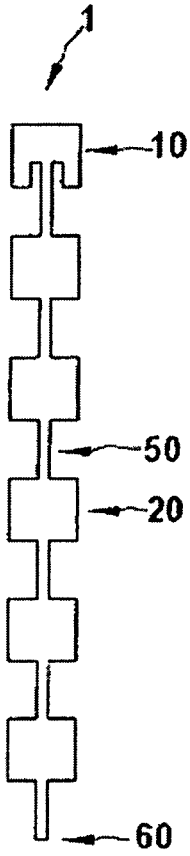
Fig. 3b Prior Art
Figure 3C:
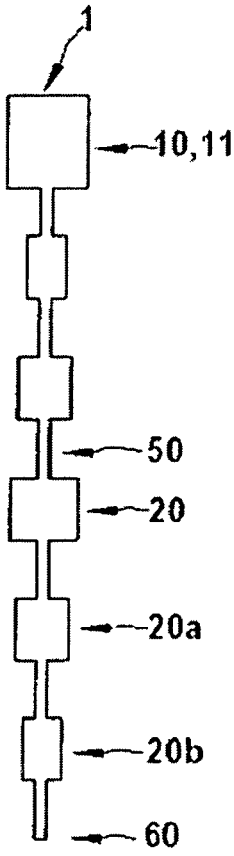
Fig. 3c Prior Art
Figure 3D:
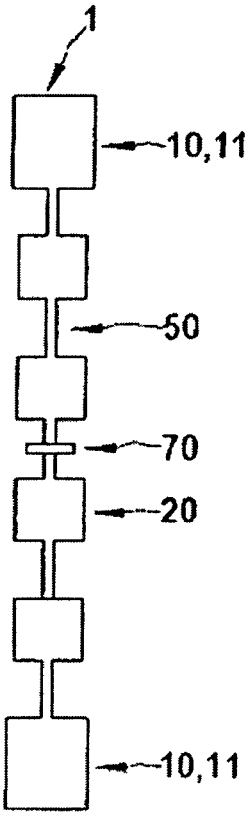
Fig. 3d Prior Art

In order to achieve such a power distribution in a serially fed column, according to the related art patch elements 20 are modified as a function of their position on the column to modify the fraction of the available power emitted by an element (20*a* and 20*b*) and thus to achieve improved power distribution. Such a column is schematically shown in FIG. 3*c*.

In general, however, the possible adjustment via the patch elements of the related art is insufficient for achieving sufficient side lobe suppression. Flexible adjustment of the directional characteristic is also not possible using this patch element. A novel patch element is presented within the scope of the present invention, which together with conventional patch elements according to FIGS. 4*a* and 4*b* makes it possible to provide any desired radiation of the power available on the feed line at the input of the element.

Figure 4A:
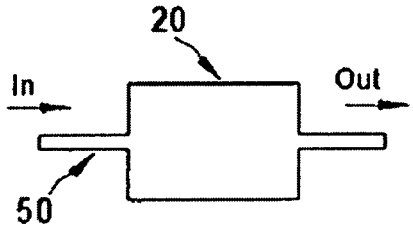
Fig. 4a Prior Art
FIG. 4*a* shows a conventional patch element within a planar, serially fed antenna column.
Figure 4B:
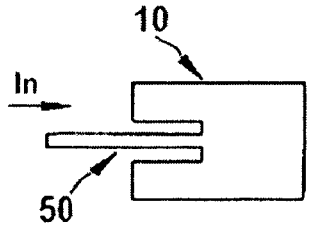
Fig. 4b Prior Art
FIG. 4*b* shows a patch end element.
Figure 5:
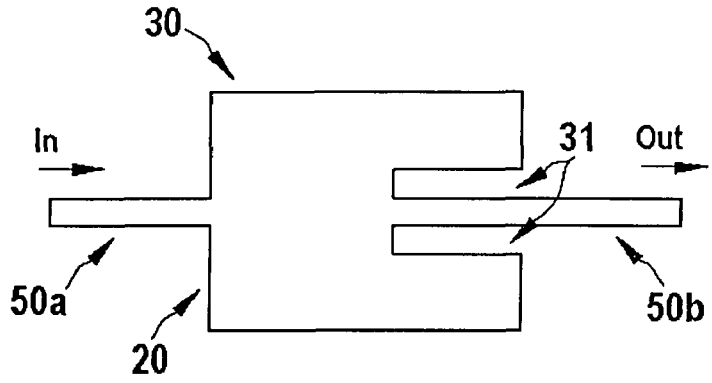
FIG. 5 shows a patch element according to the present invention.

The basis of patch element 30 of FIG. 5 according to the present invention is patch element 20 of FIG. 4*a* of the related art. Patch element 20 of the related art essentially has a widened line segment whose length is usually one-half of the wavelength on a line of comparable width to maximize the radiation and minimize the reflection. The irradiated power of the power available at the input of the element is usually adjusted via the width of the line segment. In the following, patch element 20 of the related art is also referred to in a simplified manner as a widened line segment or just as a line segment.

Patch element 30 according to the present invention (FIG. 5) contains, unlike the related art, two slots 31 in the output area of the patch element, which run in particular above and below the continuation of feed line 50*b*. The continuation of feed line 50*b* is thus offset into line segment 20 at the output of the patch element. The impedance relationships within the patch element are thus modified in such a way that more power is irradiated compared to the related art and thus less power is made available for relaying on feed line 50*b* at the output of patch element 30. The irradiated power and the power relayed on signal line 50*b* are largely adjusted via the length of slots 31 and the width of line segment 20. The shape of slots 31 and the routing of feed line 50*b* in the area of slots 31 may differ from those in the drawing of FIG. 5.

Figure 6:
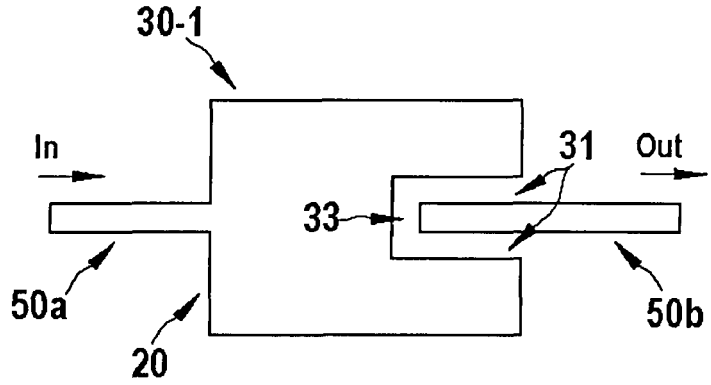
FIG. 6 shows a modified embodiment of a patch element.

A first embodiment 30-1 (FIG. 6) of the patch element according to the present invention contains an additional slot 33 at the beginning of the continuation of feed line 50*b*, electrically isolating the latter from line segment 20. In this way, further increase in the radiation of the power available at the input of the patch element is achieved. The power relayed on signal line 50*b* is reduced accordingly.

Figure 7:
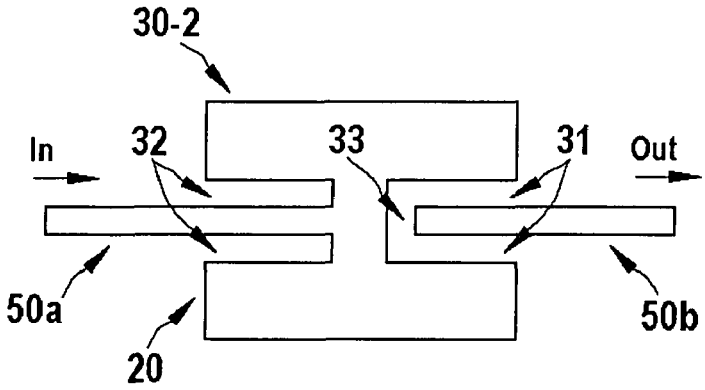
FIGS. 7 through 11 show further embodiment variants of the patch elements according to the present invention.

FIG. 7 shows another, second embodiment of patch element 30 according to the present invention, where slots 32 are introduced in line segment 20 in the area of input signal line 50*a* and at the output. These slots are used for better adaptation and control of the radiation of the patch element. The length of the slots is an essential adjustment parameter. The shape of slots 32 and the routing of feed line 50*a* in the area of the slots may differ from those in the drawing of FIG. 7.

Figure 8:
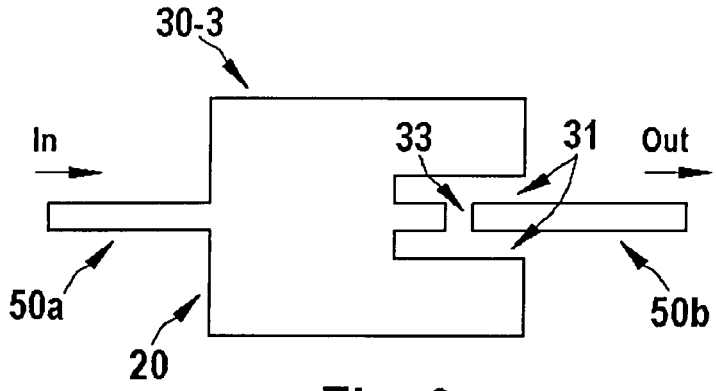
Figure 9:
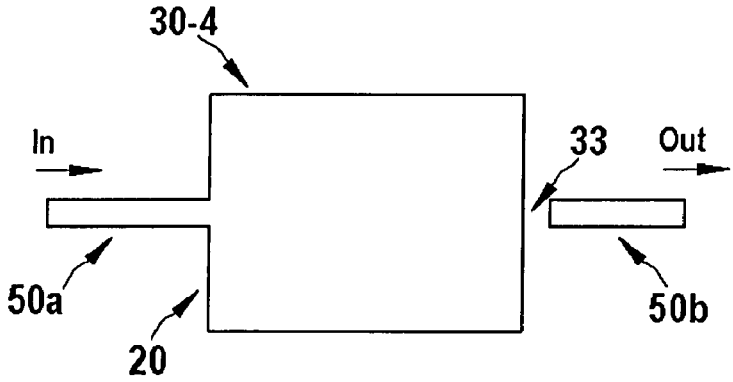

FIG. 8 shows a third embodiment based on the first embodiment, in which slots 31 are extended beyond the position of additional slot 33 into the line segment. This allows both the adaptation and the radiation to be additionally adjusted. Additional slot 33 is thus located in the path of the continuation of feed line 50*b*. The fourth embodiment in FIG. 9 is a special case of the first embodiment of FIG. 6 when the lengths of slots 31 are assumed to be 0 and there is only additional slot 33.

Figure 10:
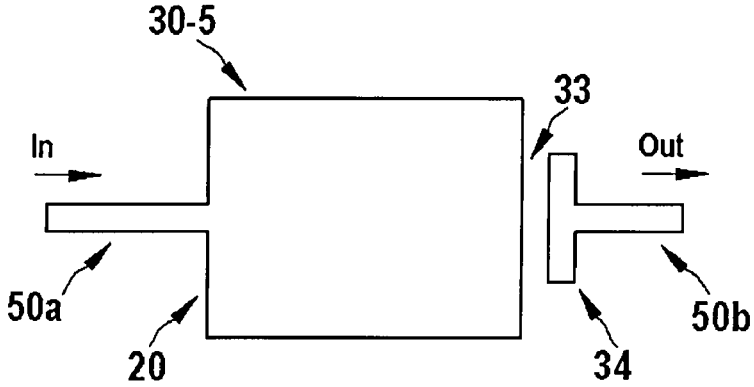
Figure 11:
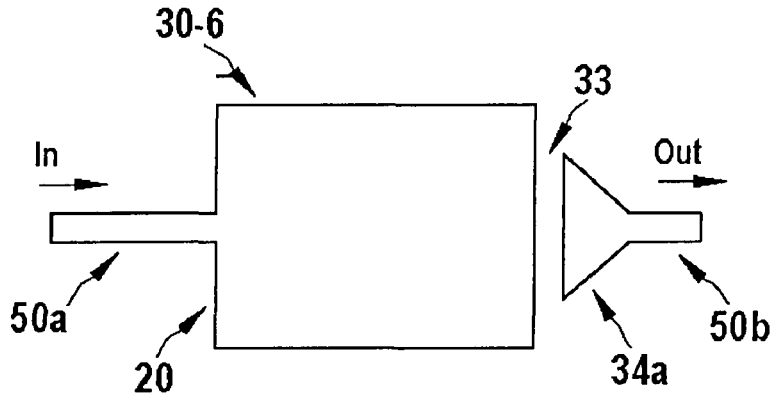
Figures 12A, 12B, 12C, 12D:
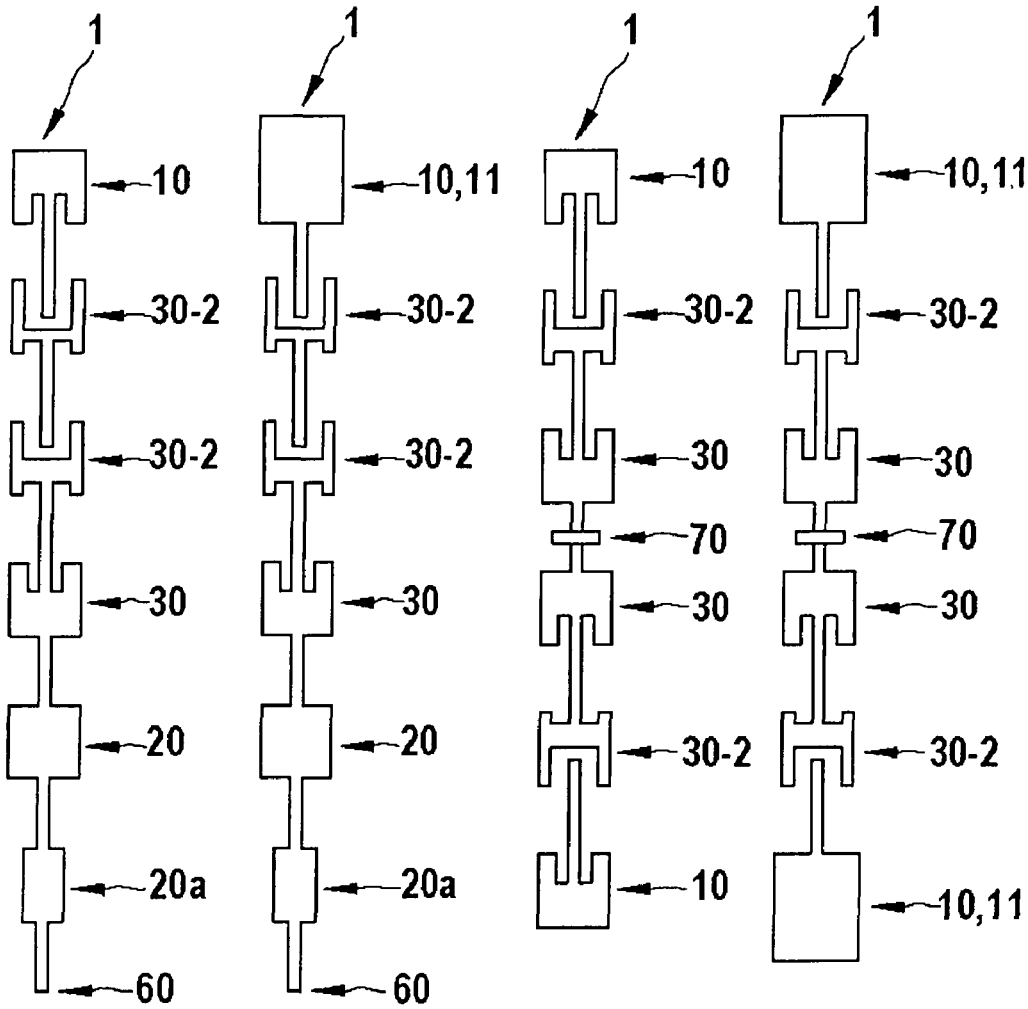
FIGS. 12*a* through 12*d* show different embodiments of combinations of conventional patch elements with patch elements according to the present invention.

The coupling between the continuation of signal line 50*b* at the output of the patch element and line segment 20 may be achieved in the area of the additional slot over wider structures on signal line 50*b*. FIGS. 10 and 11 show exemplary embodiments having structures 34 and 34*a*. Other shapes and lengths of these widened coupling structures are implementable.

The use of standard adaptation structures taken from microwave stripline technology is possible at the input of signal line 50*a* and the output of signal line 50*b* on the patch elements to optimize reflections and radiation.

FIGS. 12*a* through 12*d* show different embodiments of combinations of patch elements according to the related art and patch elements according to the present invention to form planar, serially fed antenna columns.

Of course, the above-mentioned antenna structures may be used for both transmitting antennas and receiving antennas or combinations thereof.

What is claimed is:

1. An antenna structure, comprising:

a plurality of serially fed antenna columns which are situated in an elevation direction and which operate in an elevation plane;

a feed line; and a plurality of serially fed patch elements, at least one of the patch elements having a slot coupling to a continuation of the feed line for use in the antenna columns and influencing a radiation of the at least one patch element, the continuation of the feed line varying beam formation and side lobe suppression in the elevation plane of the antenna columns;

wherein the patch elements are spaced apart from each other by a distance and are electrically isolated from each other.

2. The antenna structure according to claim 1, wherein the slot is situated in the patch element directly above and below the continuation of the feed line.

3. The antenna structure according to claim 1, wherein the slot is situated between a beginning of the continuation of the feed line and the patch element.

4. The antenna structure according to claim 3, wherein the beginning of the continuation of the feed line has a widened design.

5. The antenna structure according to claim 1, wherein the slot is situated in a path of the continuation of the feed line in an area of the patch element.

6. The antenna structure according to claim 1, wherein the at least one patch element having the slot coupling to the continuation of the feed line is combined with other of the patch elements within a serial feed path, the at least one patch element having the slot coupling exhibiting a higher radiation level than the other patch elements.

7. The antenna structure according to claim 1, wherein the slot is situated in the patch element directly above and below the continuation of the feed line, wherein the beginning of the continuation of the feed line has a widened design, and wherein the at least one patch element having the slot coupling to the continuation of the feed line is combined with other of the patch elements within a serial feed path, the at least one patch element having the slot coupling exhibiting a higher radiation level than the other patch elements.

8. The antenna structure according to claim 1, wherein the slot is situated between a beginning of the continuation of the feed line and the patch element, wherein the beginning of the continuation of the feed line has a widened design, and wherein the at least one patch element having the slot coupling to the continuation of the feed line is combined with other of the patch elements within a serial feed path, the at least one patch element having the slot coupling exhibiting a higher radiation level than the other patch elements.

9. The antenna structure according to claim 1, wherein the slot is situated in a path of the continuation of the feed line in an area of the patch element, wherein the beginning of the continuation of the feed line has a widened design, and wherein the at least one patch element having the slot coupling to the continuation of the feed line is combined with other of the patch elements within a serial feed path, the at least one patch element having the slot coupling exhibiting a higher radiation level than the other patch elements.

10. A radar sensor, comprising:

a plurality of serially fed patch elements, a serial feed path forming an antenna column within a group antenna, at least one of the patch elements having a slot coupling to a continuation of a feed line for use in the antenna column and influencing a radiation of the at least one patch element, the continuation of the feed line varying beam formation and side lobe suppression in the elevation plane of the antenna column;

wherein the patch elements are spaced apart from each other by a distance and are electrically isolated from each other, and wherein the group antenna includes an antenna structure that includes a plurality of serially fed antenna columns which are situated in an elevation direction and which operate in an elevation plane, the feed line, and the plurality of serially fed patch elements.

11. The radar sensor according to claim 10, wherein the slot is situated in the patch element directly above and below the continuation of the feed line, and wherein the beginning of the continuation of the feed line has a widened design.

12. The radar sensor according to claim 10, wherein the slot is situated between a beginning of the continuation of the feed line and the patch element, and wherein the beginning of the continuation of the feed line has a widened design.

13. The radar sensor according to claim 10, wherein the slot is situated in a path of the continuation of the feed line in an area of the patch element, and wherein the beginning of the continuation of the feed line has a widened design.

14. The radar sensor according to claim 10, wherein the at least one patch element having the slot coupling to the continuation of the feed line is combined with other of the patch elements within a serial feed path, the at least one patch element having the slot coupling exhibiting a higher radiation level than the other patch elements.

15. The radar sensor according to claim 10, wherein the slot is situated in the patch element directly above and below the continuation of the feed line, wherein the beginning of the continuation of the feed line has a widened design, and wherein the at least one patch element having the slot coupling to the continuation of the feed line is combined with other of the patch elements within a serial feed path, the at least one patch element having the slot coupling exhibiting a higher radiation level than the other patch elements.

16. The radar sensor according to claim 10, wherein the slot is situated between a beginning of the continuation of the feed line and the patch element, wherein the beginning of the continuation of the feed line has a widened design, and wherein the at least one patch element having the slot coupling to the continuation of the feed line is combined with other of the patch elements within a serial feed path, the at least one patch element having the slot coupling exhibiting a higher radiation level than the other patch elements.

17. The radar sensor according to claim 10, wherein the slot is situated in a path of the continuation of the feed line in an area of the patch element, wherein the beginning of the continuation of the feed line has a widened design, and wherein the at least one patch element having the slot coupling to the continuation of the feed line is combined with other of the patch elements within a serial feed path, the at least one patch element having the slot coupling exhibiting a higher radiation level than the other patch elements.

* * * * *